US008544824B2

(12) United States Patent
Selkowitz

(10) Patent No.: US 8,544,824 B2
(45) Date of Patent: Oct. 1, 2013

(54) FOLDABLE TABLE LIFT ASSIST APPARATUS

(76) Inventor: Stephen L. Selkowitz, Valencia, PA (US)

( * ) Notice: Subject to any disclaimer, the term of this patent is extended or adjusted under 35 U.S.C. 154(b) by 0 days.

(21) Appl. No.: 13/494,142

(22) Filed: Jun. 12, 2012

(65) Prior Publication Data

US 2012/0319064 A1 Dec. 20, 2012

Related U.S. Application Data

(60) Provisional application No. 61/497,229, filed on Jun. 15, 2011.

(51) Int. Cl.
*B66D 1/36* (2006.01)

(52) U.S. Cl.
USPC ..... 254/338; 254/335; 254/336

(58) Field of Classification Search
USPC ..... 254/264, 266, 323–327, 332, 334–338, 254/382; 414/444, 543
See application file for complete search history.

(56) References Cited

U.S. PATENT DOCUMENTS 3,866,759 A * 2/1975 Lucas ..... 212/261
4,604,022 A 8/1986 Bourgraf
5,165,123 A * 11/1992 Colpron ..... 5/83.1
5,678,804 A 10/1997 Lintelman
5,975,826 A * 11/1999 Scholder ..... 414/444
6,056,273 A 5/2000 Smith
6,409,151 B1 6/2002 Cormier
7,448,330 B2 11/2008 Rivera, Jr. et al.
2006/0183574 A1* 8/2006 Stanford et al. ..... 473/481
2010/0111661 A1* 5/2010 Svanda ..... 414/543
2011/0041738 A1 2/2011 Rivera, Jr. et al.

* cited by examiner

*Primary Examiner* — Emmanuel M Marcelo
*Assistant Examiner* — Angela Caligiuri
(74) *Attorney, Agent, or Firm* — McKay & Associates, P.C.

(57) ABSTRACT

A lift-assist apparatus, including an arm having a medial portion, a distal end, and a proximal end. One or more pulleys are attached to a surface of the medial portion. An upright support includes an upper horizontal bar and a lower horizontal bar, and a hinge point is formed medially on the upper horizontal bar. A turnbuckle has a fixed end and a connecting end, the fixed end attached to the lower horizontal bar, the connecting end adapted to attach to the medial portion. The hinge point is configured as a pair of opposing tabs defining a space in which the medial portion resides, wherein a pin can be inserted through each tab and through the medial portion to pivotally fix the arm on the upright support such that the arm can pivot in an upward and downward direction and be locked into a fixed position using the turnbuckle.

8 Claims, 5 Drawing Sheets

FOLDABLE TABLE LIFT ASSIST APPARATUS

CROSS-REFERENCE TO RELATED APPLICATIONS

The instant application claims benefit of provisional application Ser. No. 61/497,229, filed Jun. 15, 2011, the contents of which are herein incorporated by reference.

BACKGROUND

1. Field of the Invention

The instant invention relates to an aid for the lifting of "roll and fold" tables, e.g. industry and school cafeteria tables, which typically are cumbersome and heavy, requiring at least two people to lift into a fold and roll position for storage purposes.

2. Description of the Related Art

Fold-and-roll tables are designed to fold upward into a transportable position, rolled and stored for multipurpose room usage. Such tables typically are used within cafeterias and conference facilities where typically variable events are held which require movement or removal of the tables. These types of tables are also frequently moved for floor cleaning and other maintenance. Examples of such tables are shown for instance within U.S. Pat. No. 7,448,330 and U.S. Patent Publication No. 2011/0101729 wherein shown are mobile folding tables, specifically including lift-assist mechanisms.

Fold-and-roll tables are extremely heavy, typically requiring multiple individuals to manipulate. The initial lifting weight with attached benches or stools when new range upwards of thirty pounds. The weight of a fatigued system could range over eighty pounds. This creates a burden and serious risk of injury to the person or persons trying to lift these tables. The increase in potential liability also adds to the concerns and budgets of school programs. Built-in lift assists, such as shown in the references above, have been created in an effort to ease the folding and storage procedure. However, the inherent problem with these and other table designs is that the built-in lift-assists will fatigue over time because the table lift systems use torsion bars, pneumatic cylinders, and spring tubes, and like all moving parts, require repair or replacement. Furthermore, even with the integral lift-assist mechanism, manual lifting is still required posing a risk of pinching, back injury, or other concerns.

What is needed then is a lift-assist for such tables which reduces the lifting force needed to fold the tables and in some embodiments eliminates the need for manual force all together, such that the fold-and-roll table can safely be folded and moved or stored even by one individual.

SUMMARY

It is the objective of the instant invention to provide a list-assist apparatus which aids and assists the custodian or cafeteria worker in school systems in lifting and transported roll-and-fold tables.

It is further an objective of the instant invention to reduce or eliminate liability associated with manually lifting large, heavy objects.

It is further an objective of the instant invention to help school systems reduce employment-related claims and increased healthcare premiums resulting from employee injury caused by manually lifting large, heavy objects.

Accordingly, what is provided is a lift-assist apparatus, comprising an arm having a medial portion, a distal end, and a proximal end. One or more pulleys are attached to a surface of the medial portion. An upright support includes an upper horizontal bar and a lower horizontal bar, and a hinge point is formed medially on the upper horizontal bar. A turnbuckle has a fixed end and a connecting end, the fixed end attached to the lower horizontal bar, the connecting end adapted to attach to the medial portion. The hinge point is configured as a pair of opposing tabs defining a space in which the medial portion resides, wherein a pin can be inserted through each tab and through the medial portion to pivotally fix the arm on the upright support such that the arm can pivot in an upward and downward direction and be locked into a fixed position using the turnbuckle.

The upright support includes a pair of vertical members and a pair of sliding tube members adapted to be received by the vertical members and slide therein in an upward and downward fashion such that the upright support is adjustable in height.

The lift-assist apparatus further comprises a base having fixed thereto the upright support, the base including a pair of base legs and multiple square tubes attached perpendicular to the base legs extending in a direction of the staggered arm. A winch is situated on a plate of the base including a cable having a cable end, the cable adapted to travel along each of the pulleys, and a battery is disposed on the plate for powering the winch. Therefore, a latching means attached to the cable end is raised and lowered in conjunction with the arm for providing an upward lifting force against the center leg hinge of the table.

DETAILED DESCRIPTION OF THE PREFERRED EMBODIMENT

Figure 1:
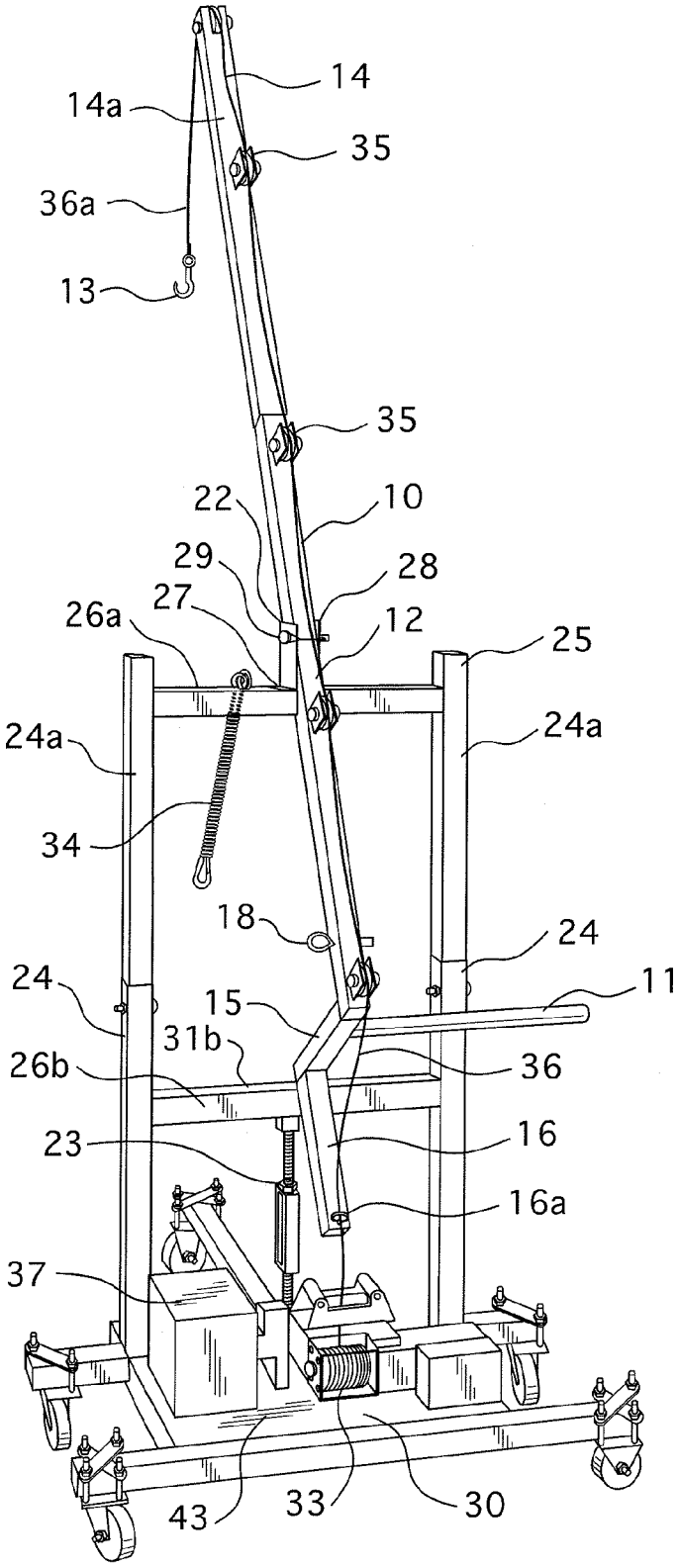
FIG. 1 shows a rear perspective view of the instant invention in one embodiment.

The invention will now be described in detail in relation to a preferred embodiment and implementation thereof which is exemplary in nature and descriptively specific as disclosed. As is customary, it will be understood that no limitation of the scope of the invention is thereby intended. The invention encompasses such alterations and further modifications in the illustrated assembly, and such further applications of the principles of the invention illustrated herein, as would normally occur to persons skilled in the art to which the invention relates. This detailed description of this invention is not meant to limit the invention, but is meant to provide a detailed disclosure of the best mode of practicing the invention.

With reference then to FIGS. 1-6, shown is the instant lift-assist apparatus, generally comprising three (3) subassemblies. Although any type of strong, rigid material such as aluminum or plastic can be used, each subassembly is preferably made of square-tube steel which therefore frames the apparatus. For instance, although not limited hereto, square-tubing, perforated or not, in the range of 1½-1¾ inches can form the base 30, upright support 25, or arm 10, as further described. Additionally, "a" or "an" as used in the claims means one or more.

The first subassembly comprises an arm 10, or staggered arm 10. Staggered arm 10 is an elongate bar having a medial portion 12, a distal end 14 and a proximal end 16. Arm 10 can be one, integral piece or be two or more square tubes each acting as arm extensions 14*a* to vary the length and therefore the height of the arm 10. Distal end 14 may terminate at a gooseneck 14*b* (FIG. 2) to level its end. The medial portion 12 is formed axially with the distal end 14. One or more pulleys 35 are attached to a surface of the medial portion 12. A transition member 15 is attached to the medial portion 12 trans-axial therewith. The proximal end 16 is attached to the perpendicular transition member 15 wherein the proximal end 16 is therefore offset from the medial portion 12 such that the staggered arm 10 is generally Z-shaped as shown, hence the term "staggered". Attached to proximal end 16 is a guide 16*a*, shown here as a fixed ring or loop through which a cable 36 may pass. An additional pulley may also be utilized at this "guide means" location.

Figures 2, 3:
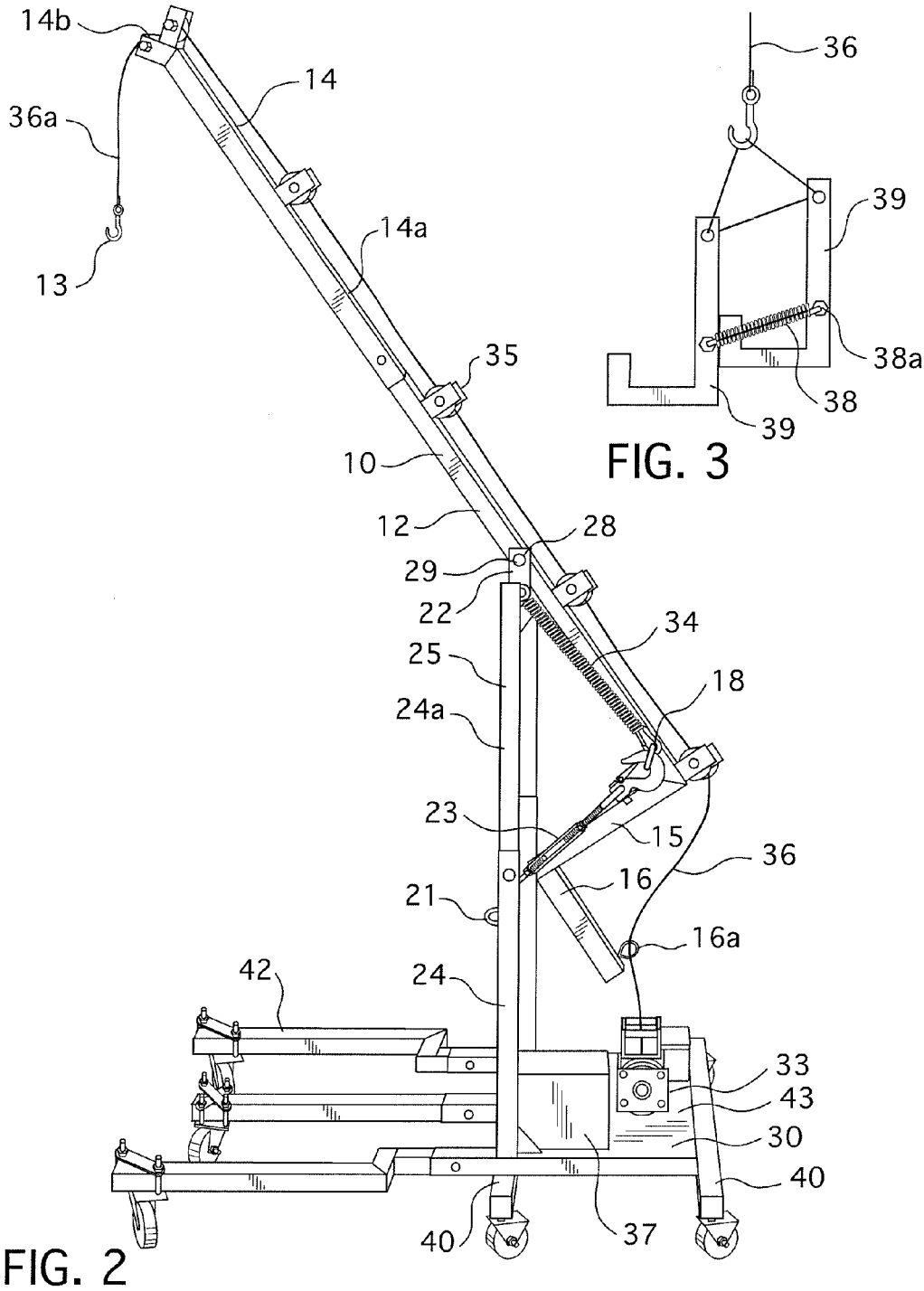
FIG. 2 shows amide view thereof.
FIG. 3 shows a perspective view of one embodiment of the hooking mechanism which grasps the hinge point of the table.

Attached to distal end 14 is a latching means 13 adapted to secure to the underside of a roll and fold table, particularly at the center leg hinge which is the central folding point of the table. Specifically, as shown in one embodiment, the latching means 13 is formed of a hook adapted to grasp near or on an underlying center leg hinge beneath the surface of the table. Any type of grasping member such as a lance hook or carabiner device may also be employed as the latching means 13. In fact, FIG. 3 shows an additional embodiment, as further described. To manipulate distal end 14 and thus the latching means 13, proximal end 16 itself may be used as a handle, for instance by grasping the proximal end 16 or by attaching a stirrup, rope or other graspable member directly to proximal end 16. Preferably, however, one or more rigid handles 11 are attached to the transition member 15 jutting out horizontally therefrom as shown. If an additional stirrup is employed it preferably has a length and width sufficient to accommodate a user's foot when the handle 11 is pushed down to where additional force or leverage may be applied as required.

The second subassembly generally comprises an upright support 25 for supporting staggered arm 10. Upright support 25 is pivotally connected to medial portion 12 of staggered arm 10 by way of a hinge point 22 such that staggered arm 10 can pivot in a vertical plane about upright support 25, as a result distal end 14 can be raised or lowered opposite proximal end 16. For instance, in one embodiment but not limited hereto and with reference to FIG. 2, upright support 25 can be formed of a frame having two vertical members 24 and upper and lower horizontal bars 26*a*, 26*b* connected to the ends of the vertical members 24 and sliding tube members 24*a* spanning the width of the vertical members 24 to form generally a rectangular frame with the upper horizontal bar 26*a* having a midpoint 27. Accordingly, hinge point 22 is formed at the midpoint 27. As shown, hinge point 22 is configured as a pair of upstanding rigid tabs 28. A pin 29, bolt or similar fastener therefore passes through each tab 28 and further passes through the tubular medial portion 12 to form the pivotal connection between the upright support 25 and staggered arm 10. A lower horizontal bar 26*b* is situated below the upper horizontal bar 26*a* and connected to the vertical members 24. A lower eyebolt 21 is secured to lower horizontal bar 26*b* adapted to receive an end of a turnbuckle 23. In turn, the other end of turnbuckle 23 is configured to attach to one of two eyebolts, as will be further described.

Particularly, upright support 25 comprises a pair of vertical members 24. A pair of sliding tube members 24*a* are adapted to be received by the vertical members 24 and slide therein in an upward and downward fashion such that said upright support 25 is adjustable in height, the sliding tube members 24*a* fixed within the vertical members 24 using pins or bolts. In this embodiment the height of upright support 25 may range from 30 inches to 60 inches for example. Upper horizontal bar 26*a* connects to each sliding tube member 24*a* to define the width between the sliding tube members 24*a* and thus the frame, for instance two feet. Lower horizontal bar 26*b* then has a lower front 31*a* and a lower top surface 31*b* and connects between the vertical members 24 below the upper horizontal bar 26*a*. As above, hinge point 22 as shown is formed medially on the upper horizontal bar 26*a*.

A spring 34 having two ends is attached to the upper horizontal bar 26*a*, for instance at a bolt or eye hook proximate to hinge point 22 as shown. As shown in FIG. 1 the second spring end is dangling, unattached when the lift-assist apparatus is used with a winch 33, as further described. In contrast, FIG. 2 shows the second spring end clipped to the medial eyebolt 18. Accordingly, the spring 34 can serve several purposes, namely to allow for the manual use of the lift-assist apparatus, i.e. without the winch 33, and also allows for the temporary fixing of the arm 10 until the turnbuckle 23 is also fastened to the medial eyebolt 18 to lock the arm 10 into a heightened position. Additionally, when the spring 34 is attached to the medial eyebolt 18, if the turnbuckle 23 is not yet in the desired position, a slight resistance is provided to the arm 10 such that when the latching means 13 is pulled down and fastened to the center leg hinge, the arm 10 rebounds slightly upward back into its upright position with the cable 36 of the winch 33 now partially taut. The turnbuckle 23 can then be locked, which employs the use of a lower eyebolt 21 fastened to the lower front 31*a*. The turnbuckle 23 therefore has a fixed end 61 and a connecting end 62. The fixed end 61 is attached to the lower eyebolt 21, and the connecting end 62 is adapted to attach to the medial eyebolt 18 in similar fashion as the second spring end.

The third subassembly comprises a base 30. A pair of parallel base legs 40 form an outer perimeter of base 30, and multiple square tubes 41 are attached perpendicularly to the base legs 40 extending in a direction of the arm 10 as shown. One or more leg extensions 42 can be used to enhance stability, in which case each leg extensions 42 is configured to seat within each square tube 41 and extend further in the direction of the arm 10 relative to the square tubes 41 and locked into place using any type of pin or bolt. The base 30 further comprises a rigid plate 43. The winch 33 is situated on the plate 43 and includes a cable 36 having a cable end 36*a*, the cable 36 adapted to travel through and along each of the pulleys 35. The winch 33 can be of the remote-controlled, battery operated type for example, and although not limited hereto, in the preferred embodiment a 3,000 lb. winch 33 is employed. By being remote controlled, the operation of winch 33 can safely be performed remote from the lift-assist apparatus once the latching means 13 is fastened. If a battery 37 is used for powering the winch 33 it can be disposed on the plate 43. Alternative to a winch 33, a hydraulic or pneumatic cylinder may be implemented.

Next, the latching means 13 is attached to the cable end 36*a* adapted to secure to the center leg hinge of the foldable table. In one embodiment latching means 13 is formed as a hook (also 13). In an alternative embodiment and with particular reference to FIG. 3, the latching means 13 comprises a pair of opposing hooks 39 connected at ends of a rod 38*a*. A latch spring 38 is disposed over the rod 38*a* between the pair of hooks 39 such that each hook 39 would engage either side of the center leg hinge and upon the upward pulling force provided by the lift-assist apparatus the two hooks 39 would compress towards one another and simultaneously provide a more secure grip around either side of the center leg hinge of the table.

In use then the entire assembly is rolled or otherwise located near an unfolded, ready to seat table such as a school cafeteria table. In an opened position the table's underside is parallel to the floor and therefore typically has its framed leg supports at ground contact. Latching means 13 is connected at or near one of the center leg hinges to hook across the metal portion thereof. As a result, either manually or mechanically the latching means 13 lifts the table into an elevated "teepee" fold and roll position such that the table can be rolled to the stored location.

Figure 6:
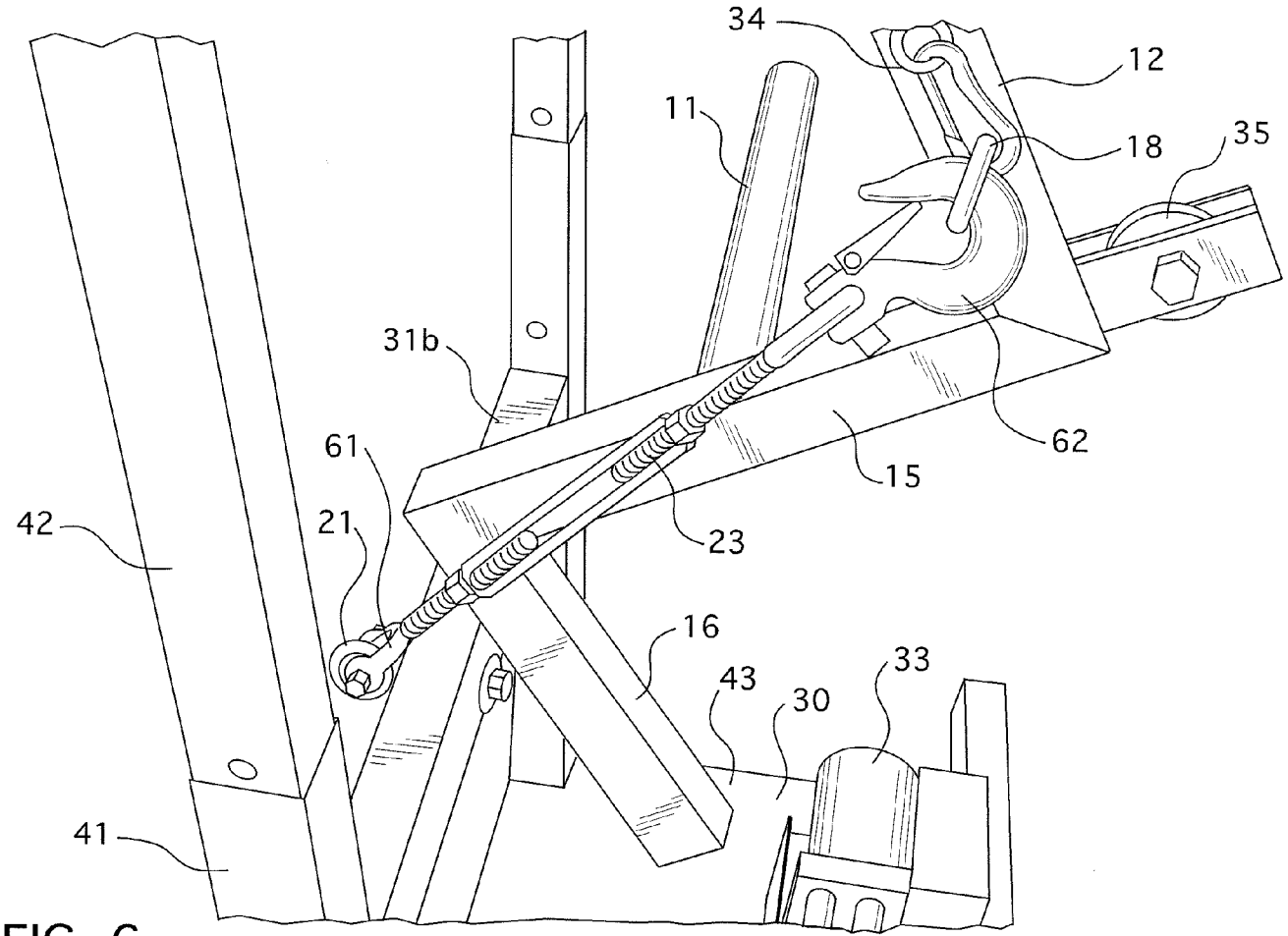
FIG. 6 shows a close-up perspective view of the medial portion of the arm which includes a turnbuckle.

Accordingly, there are various modes of use. With reference to FIG. 1, shown is the mechanical embodiment in which the pulleys 35 and winch 33 are used. Winch 33 is routed through pulleys 35 with latching means 13 at the cable end 36*a* dangling over distal end 14. In FIG. 1 the arm 10 is still free to move into a desired height since both spring and turnbuckle 23 are disengaged with medial eyebolt 18. Once a desired height is achieved, the arm 10 can be locked into its desired height using turnbuckle 23. By being locked into place the staggered arm 10 is prohibited from moving as the powered winch 33 provides the necessary pulling force. See FIGS. 2 and 6. Spring 34 attached at the same location can be utilized to temporarily maintain arm 10 close to its desired location hands-free while turnbuckle 23 is manually adjusted. Spring 34 can be directly attached to medial eyebolt 18 or any type of latch, lance hook, or carabiner can be used as the connection point as shown in FIG. 6. Once arm 10 is positioned, latching means 13 is lowered, hooked under center leg hinge of table, and winch 33 is reversed to raise latching means 13 and therefore center leg hinge, resulting in the folding of the table. Of note is that use of the turnbuckle 23 further allows the arm 10 to be locked into a more level or horizontal position to move through doorways or other low-profile areas, then subsequently raised at the location of use.

Figure 4:
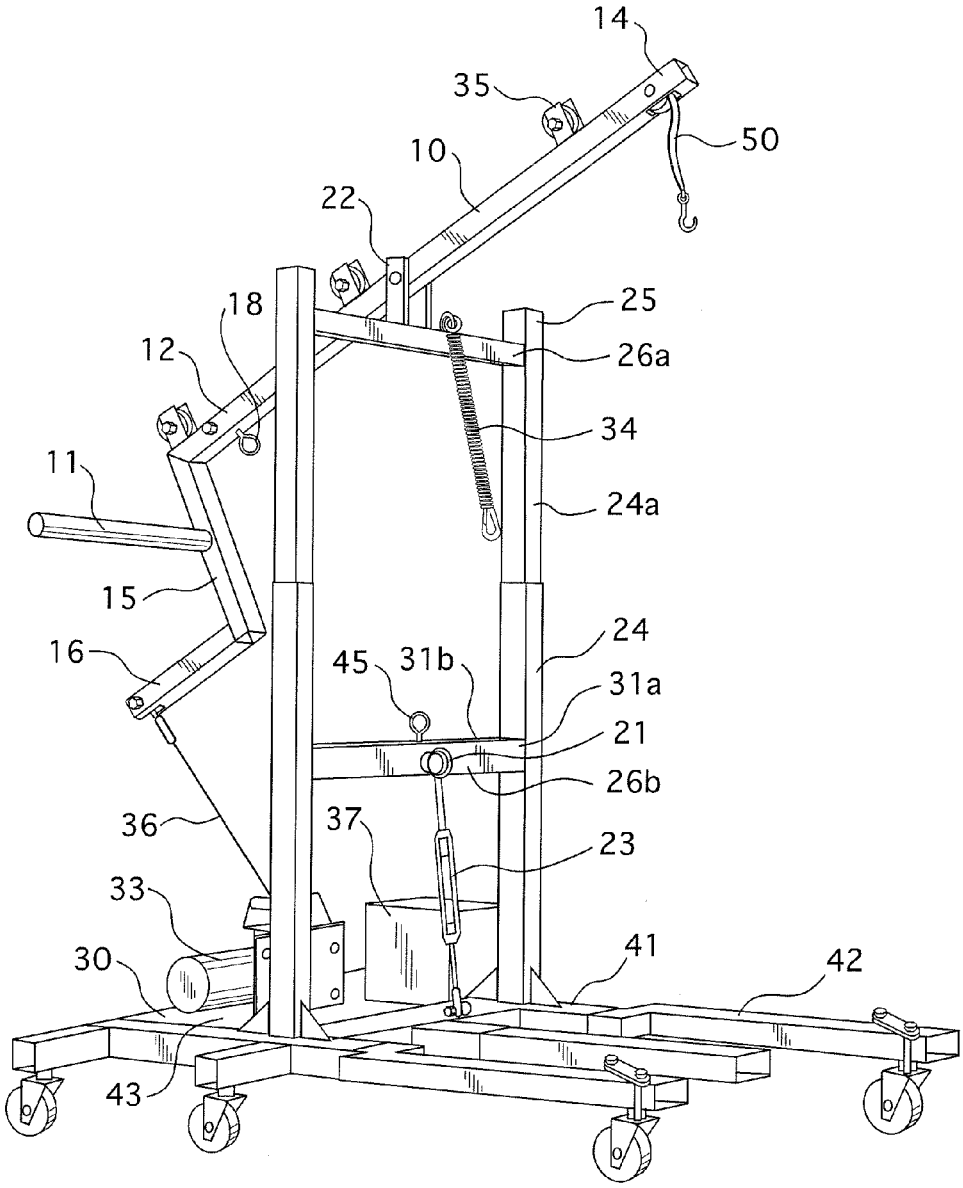
FIG. 4 shows a perspective view of an alternative embodiment of the instant invention.

In an alternative embodiment and with reference to FIG. 4, the cable end 36*a* of winch 33 is attached to the proximal end 16 to a proximal bolt 60 or similar fastening means. In this embodiment the pulleys 35 are not used, rather the pulling force of the winch 33 directly at the proximal end 16 provides increased lifting leverage for heavier tables or objects. Since the winch 33 does not travel through the pulleys 35 to dangle over distal end 14, the latching means 13 in this embodiment is configured as a nylon strap 50 which is attached within the interior of the distal end 14, having a looped end connected to a pin or bolt within the square tubing. A hook 13 is then attached directly to the nylon strap 50 at the other, dangling end, which passes through a cut-out. Upon lowering of the proximal end 16, the distal end 14 is raised and so too the roll and fold table center leg hinge as latching means 13 pulls upward against the center leg hinge to fold the table. Of note also in this embodiment the arm 10 is shorter because arm 10 extension is not employed, which optionally can be used to extend the reach and height of the arm 10 (see FIG. 1 and above). It should also be understood that use of the winch 33 in this embodiment can be eliminated all together such that the arm 10 can be manipulated manually depending on the weight of the object or table.

Figure 5:
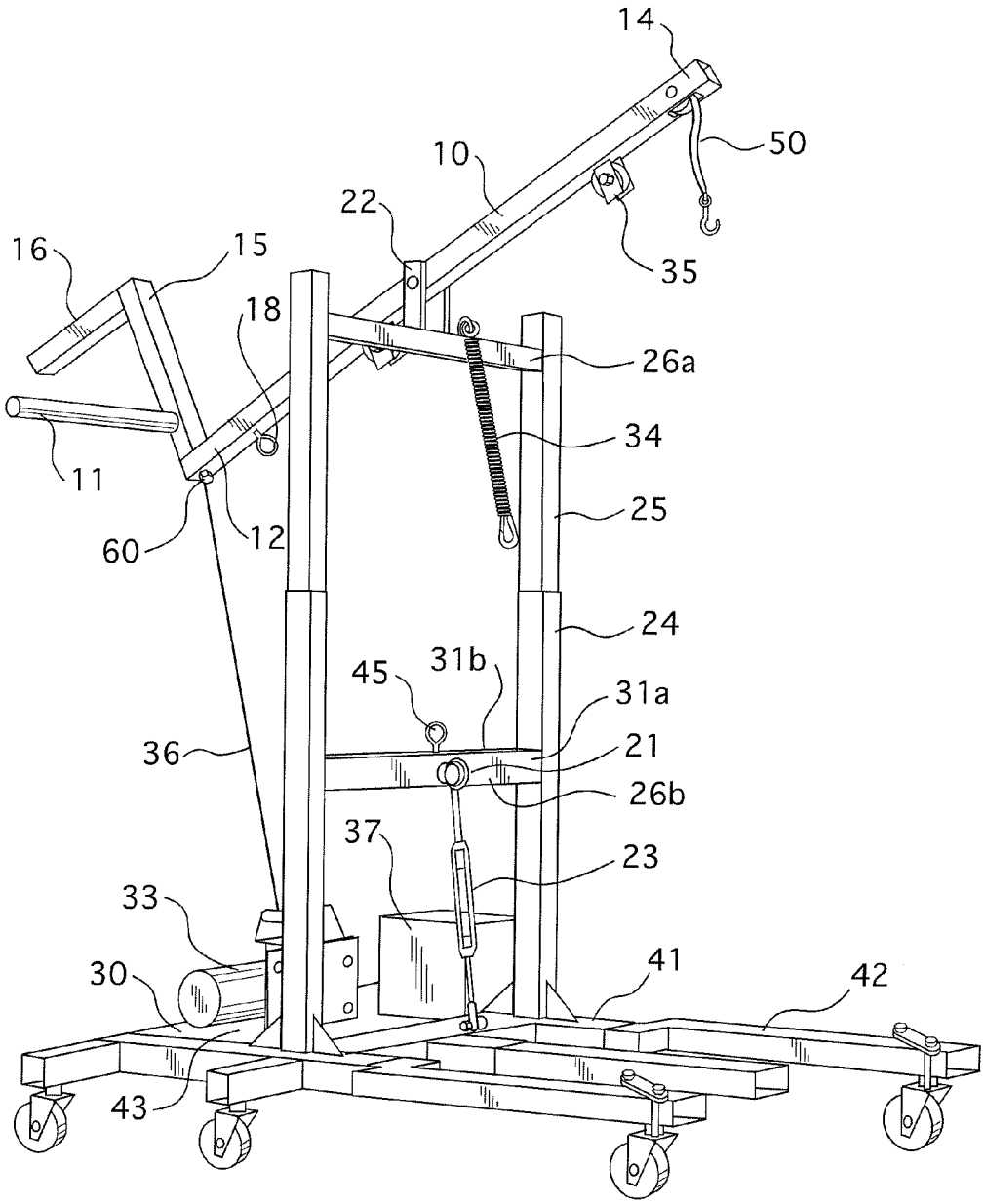
FIG. 5 shows a perspective view of a further embodiment.

In a further embodiment and with reference to FIG. 5, shown is an embodiment similar to FIG. 4 but for the inversion of arm 10. Arm 10 can be inverted to even further change the amount of leverage and distance of pull. For instance, the cable end 36*a* of winch 33 can be attached near the transition member 15 (now inverted) to any type of bolt, pin, fastener, or directly to the transition member 15, such that the winch 33 is pulling a greater distance, resulting in an increased vertical travel of distal end 14. In similar fashion, if the winch 33 is not employed, greater leverage is attained for the manual movement of proximal end 16 using handle 11 since handle 11 begins at a higher location relative to the floor when the arm 10 is inverted. In this embodiment the turnbuckle 23 can be utilized at various locations such as by attaching fixed end 61 to alternative eyebolt 45 and connecting end 62 to medial eyebolt 18.

I claim:

1. A lift-assist apparatus, comprising:

a staggered arm having a medial portion, a distal end, a transition member, and a proximal end, said medial portion formed axially with said distal end, said transition member attached to said medial portion trans-axial therewith, and said proximal end attached to said transition member wherein said proximal end is offset from said medial portion such that said staggered arm is generally Z-shaped;

a medial eyebolt fastened to said medial portion;

a guide attached to said proximal end;

a handle attached to said transition member;

an upright support, further comprising:

a pair of vertical members;

a pair of sliding tube members adapted to be received by said vertical members and slide therein in an upward and downward fashion such that said upright support is adjustable in height;

an upper horizontal bar connecting to each said sliding tube members defining a width between said sliding tube members;

a lower horizontal bar having a lower front and a lower top surface and connected between said vertical members below said upper horizontal member;

a hinge point formed medially on said upper horizontal bar;

a spring having a first spring end and a second spring end wherein said first spring end is attached to said upper horizontal bar;

a lower eyebolt fastened to said lower front;

a turnbuckle having a fixed end and a connecting end, said fixed end attached to said lower eyebolt, said connecting end adapted to attach to said medial eyebolt; and, a base having fixed thereto said upright support, said base including a pair of legs and multiple square tubes attached perpendicular to said legs extending in a direction of said staggered arm.

2. The lift-assist apparatus of claim 1, further comprising one or more pulleys attached to a surface of said medial portion.

3. The lift-assist apparatus of claim 1, wherein said base further comprises:

a plate acting as a support for said pair of vertical members;

a winch including a cable having a cable end and disposed on said plate, said cable adapted to travel through said guide and along each of said pulleys;

a battery disposed on said plate for powering said winch;

one or more base extensions, each said base extension configured to seat within each said square tube and extend further in said direction of said staggered arm relative to said square tubes.

4. The lift-assist apparatus of claim 1, further comprising a latching means within an interior of said distal end, said latching means configured to travel through a slot at an underside of said distal end.

5. The lift-assist apparatus of claim 1, further comprising a latching means attached to said cable end.

6. The lift-assist apparatus of claim 5, wherein said latching means comprises a pair of opposing hooks connected at ends of a rod and a latch spring over said rod.

7. The lift-assist apparatus of claim 1, further comprising a gooseneck attached to said distal end.

8. The lift-assist apparatus of claim 1, further comprising an arm extension configured to attach to said distal end or said medial portion to vary the length of said staggered arm.

* * * * *